US005338215A

United States Patent [19]

Lee et al.

[11] Patent Number: 5,338,215

[45] Date of Patent: Aug. 16, 1994

[54] JACK ASSEMBLY INCLUDING A CONTACT SWITCHING SYSTEM

[75] Inventors: Shiuan E. Lee; Yuen P. Wong, both of Singapore, Singapore; David L. Brunker, Naperville, Ill.

[73] Assignee: Molex Incorporated, Lisle, Ill.

[21] Appl. No.: 33,929

[22] Filed: Mar. 19, 1993

[51] Int. Cl.[5] ..... H01R 13/703

[52] U.S. Cl. ..... 439/188; 439/607; 439/668; 200/51.1

[58] Field of Search ..... 439/188, 607–610, 439/668, 669; 200/51.09, 51.10

[56] References Cited

U.S. PATENT DOCUMENTS

| | | | |
|---|---|---|---|
| 3,166,649 | 1/1965 | Frantz et al. | 439/668 |
| 3,536,870 | 10/1970 | Izumi | 200/51.09 |
| 3,949,180 | 4/1976 | Ojima et al. | 200/51.10 |
| 4,392,708 | 7/1983 | Bailey et al. | 339/182 R |
| 4,398,784 | 8/1983 | Takihara | 439/188 |
| 4,633,048 | 12/1986 | Komatsu | 200/51.1 |
| 4,938,704 | 7/1990 | Fujiura | 439/607 |
| 4,978,310 | 12/1990 | Shichida | 439/668 |
| 5,083,945 | 1/1992 | Miskin et al. | 439/607 |

OTHER PUBLICATIONS

Photograph of Molex Jack Connector.

Photograph of Pan International Jack Connector.

*Primary Examiner*—P. Austin Bradley

*Attorney, Agent, or Firm*—Charles S. Cohen

[57] ABSTRACT

A jack assembly is provided with a contact switching system for receiving a coaxial plug. The assembly includes an insulative housing having a terminal-receiving chamber and an aperture communicating with the chamber for insertion therethrough of the coaxial plug. The housing includes a terminal pivot support in the chamber. A fixed terminal is mounted on the housing and includes a fixed contact portion located in the chamber. A movable terminal is mounted on the housing and includes a cantilevered spring contact arm projecting from the terminal pivot support for pivoting thereabout. The cantilevered spring contact arm includes a first contact portion for contacting the contact portion of the fixed terminal and a second contact portion for contacting the coaxial plug when inserted into the chamber. The spring contact arm is resiliently preloaded to bias the first contact portion against the contact portion of the fixed terminal. The spring contact arm is configured so that the first contact portion slides along and wipes over the contact portion of the fixed terminal when the coaxial plug is inserted into the chamber and in contact with the second contact portion of the movable terminal.

14 Claims, 5 Drawing Sheets

JACK ASSEMBLY INCLUDING A CONTACT SWITCHING SYSTEM

FIELD OF THE INVENTION

This invention generally relates to the art of electrical connectors and, particularly, to a jack assembly which includes a contact switching system for receiving a coaxial plug.

BACKGROUND OF THE INVENTION

Shielded electrical connector assemblies are widely used in various applications such as telecommunications equipment, computers and the like. The electrical wiring in such applications often include electrical cables having a plurality of electrically conductive leads surrounded and protected by an electrically conductive shield, such as a braid, foil or the like. In most such connector assemblies, it is necessary to shield the signal-carrying circuits to avoid the reception or emission of electromagnetic interference caused by energy generated outside as well as inside the system.

Many such electrical connector assemblies are used in conjunction with systems which incorporate printed circuit boards to which the connectors are surface-mounted or with panels having apertures through which the connectors are mounted. Often, either the board or the panel have ground planes or plates to which the connectors are conductively coupled. The coupling usually is through the shield of the connector assemblies. One type of shielded electrical connector assembly is a jack which is "box" or rectangularly shaped and includes a rectangularly shaped dielectric housing having a front face and outside portions surrounding the front face covered by a stamped and formed metal shield.

One such application of shielded jacks is for receiving a pin-type coaxial plug insertable through a hole in the front of the metal shield and into a cavity or chamber within the dielectric housing. The coaxial plug has a plurality of radially insulated terminals which are exposed at a tip of the plug in a fashion to provide axially separated terminal sections. The dielectric housing of the jack mounts a plurality of pairs of movable contacts or terminals and fixed contacts or terminals, with the movable contacts being engageable by the terminal sections of an inserted plug. The terminal sections of the plug not only establish electrical connection with the movable contacts, but the plug moves the movable contacts away from the fixed contacts to effect contact switching functions. One of the problems with jacks of this type is to maintain or ensure good electrical contact between the movable and fixed contacts. The engaging surfaces of the contacts often become contaminated which deteriorates the effectiveness of the contact coupling therebetween. Attempts have been made to provide a wiping action between the engaging surfaces of the movable contacts and the fixed contacts to counteract such contamination. However, most such jack assemblies are extremely small due to the ever-increasing miniaturization of such connector assemblies. The compact envelope afforded by such miniature constructions leave little room for providing adequate wiping actions.

This invention is directed to solving those problems by providing a unique contact construction which provides an improved and more extensive wiping action between the movable and fixed contacts than has heretofore been available.

SUMMARY OF THE INVENTION

An object, therefore, of the invention is to provide a new and improved jack assembly which includes a contact switching system for receiving a coaxial plug, and with the contacts of the jack assembly having an improved wiping action.

In the exemplary embodiment of the invention, the jack assembly includes an insulative housing having a terminal receiving chamber and an aperture communicating with the chamber for insertion therethrough of the coaxial plug. The housing includes at least one terminal pivot support means in the chamber. At least one fixed terminal is mounted on the housing and includes a fixed rounded contact portion located in the chamber. At least one movable terminal is mounted on the housing and includes a cantilevered spring contact arm projecting from the terminal pivot support means of the housing for pivoting thereabout. The contact arm includes a first contact portion for contacting the rounded contact portion of the fixed terminal and a second contact portion for contacting the coaxial plug when inserted into the chamber. The spring contact arm is resiliently preloaded to bias the first contact portion against the rounded contact portion of the fixed terminal. The spring contact arm is configured so that the first contact portion slides along and wipes over the rounded contact portion when the coaxial plug is inserted into the chamber and in contact with the second contact portion.

In particular, the cantilevered spring contact arm has a dog-leg configuration defining a pair of relatively angled legs which are preloaded in a biased condition toward each other when the fixed terminal and the movable terminal are in engagement. When the coaxial plug is inserted into the jack and moves the movable terminal away from the fixed terminal, the angled legs of the preloaded spring contact arm of the movable terminal spread apart from their preloaded condition as the first contact portion moves off of the rounded contact portion of the fixed terminal to enhance a wiping action therebetween.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
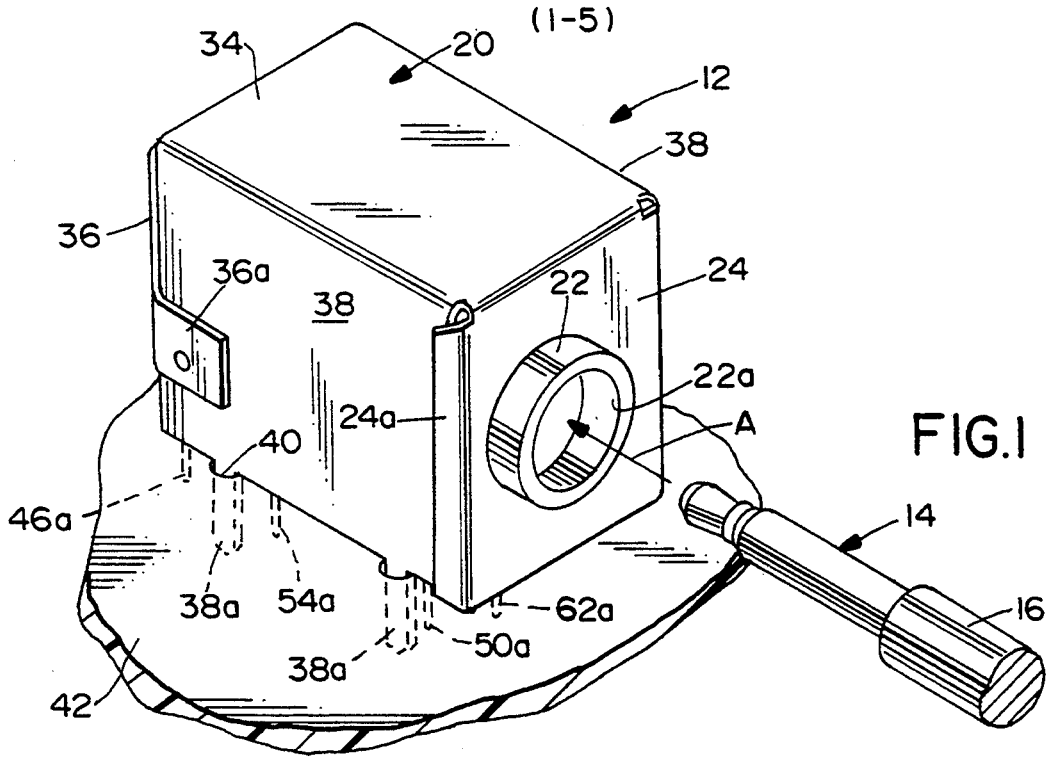
FIG. 1 is a perspective view of one embodiment of a jack assembly incorporating the concepts of the invention, in conjunction with a mating coaxial plug, with the jack assembly mounted to a printed circuit board.
Figure 2:
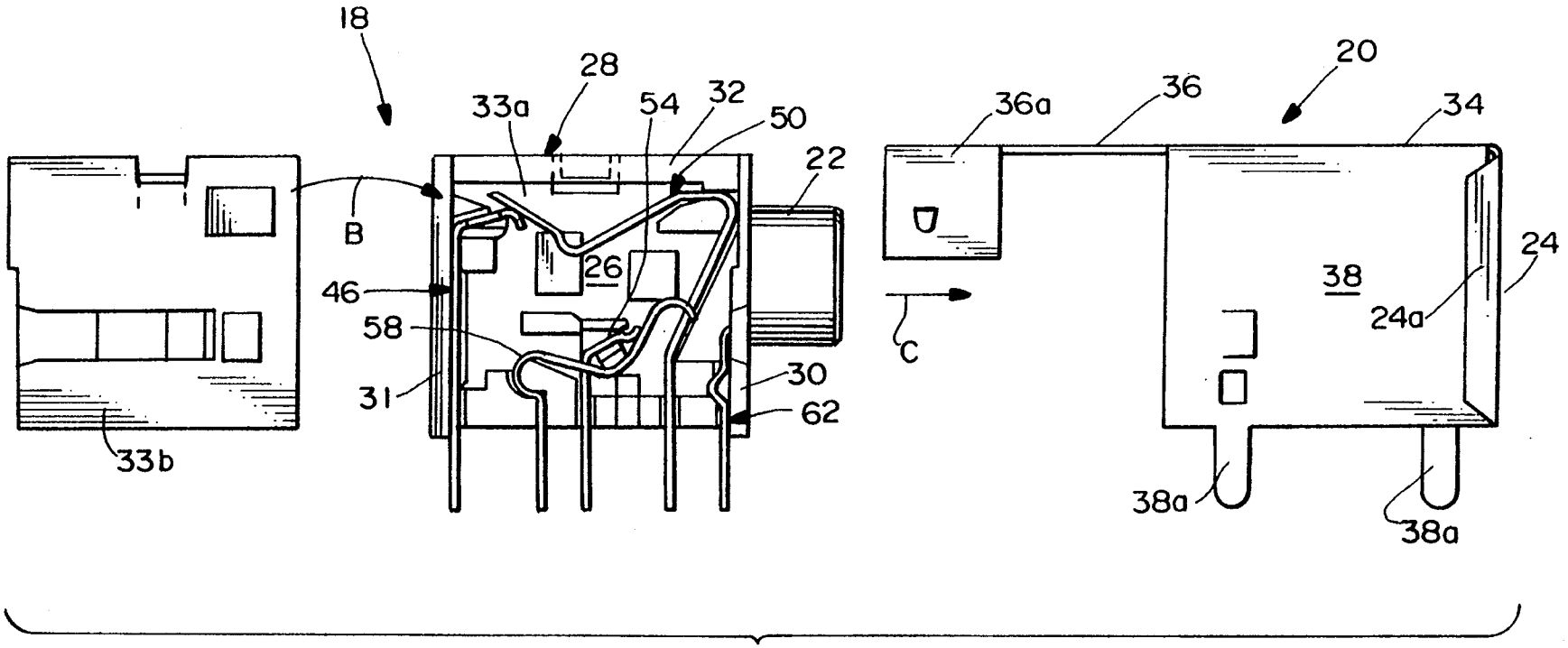
FIG. 2 is an exploded view of the jack assembly components.

Referring to the drawings in greater detail, and first to FIGS. 1 and 2, the invention is embodied in a jack assembly, generally designated 12 (FIG. 1), which includes a contact switching system, for receiving a coaxial plug, generally designated 14. The coaxial plug is terminated to a shielded electrical cable 16. The jack assembly is a shielded electrical connector assembly of a "box" or rectangular shape and includes a rectangularly shaped dielectric housing, generally designated 18 (FIG. 2), which is substantially surrounded by a stamped and formed metal shield, generally designated 20, as best seen in FIG. 1. The housing has a circular or cylindrical boss 22 which projects through a front wall 24 of the shield and through which coaxial plug 14 is inserted in the direction of arrow "A" (FIG. 1). Circular boss 22 defines a plug-receiving aperture 22*a* communicating with a chamber 26 (FIG. 2) within housing 18 and into which the coaxial plug is inserted.

Referring particularly to FIG. 2, dielectric housing 18 is formed of a plurality of components, including a unitary main body, generally designated 28, having integral front and rear walls 30 and 31, respectively, a top wall 32, and a side wall 33*a*. Once the terminals (described hereinafter) are mounted within the main body, a side wall 33*b* is assembled to the main body, as indicated by arrow "B", and is fixed in place by appropriate fastening or latch means to close chamber 26.

Stamped and formed metal shield 20 includes front wall 24, along with a top wall 34, a rear wall 36 and a pair of side walls 38 to define a five-sided shielding box having an open bottom. As seen in FIG. 2, housing 18 is assembled through the rear of shield 20 in the direction of arrow "C" before rear wall 36 of the shield is formed. Once the housing is inserted into the shield, rear wall 36 is bent downward to the position shown in FIG. 1, whereupon five sides of the housing are substantially enclosed by the box-shaped shield. Front wall 24 of the shield includes a pair of side flanges 24*a*, and rear wall 36 of the shield includes a pair of side flanges 36*a* for overlying side walls 38 of the shield. Each side wall of the shield includes a pair of depending ground legs 38*a* for insertion into holes 40 (FIG. 1) in a printed circuit board 42 to surface mount the jack assembly to the board. Ground legs 38*a* are electrically coupled, as by soldering, to appropriate circuit traces (not shown) on printed circuit board 42 or within holes 40.

Figure 4:
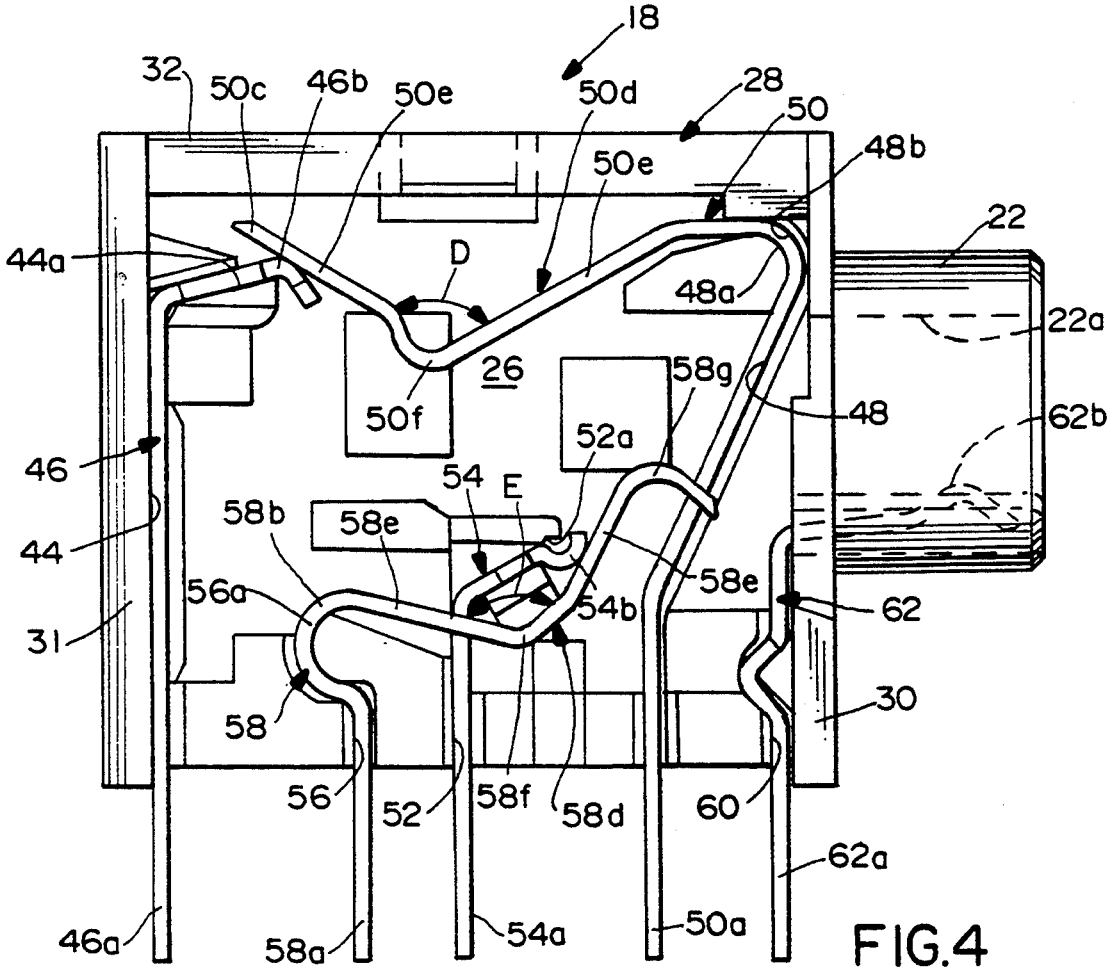
FIG. 4 is a sectional view of the dielectric housing with the terminals mounted therein.
Figure 3:
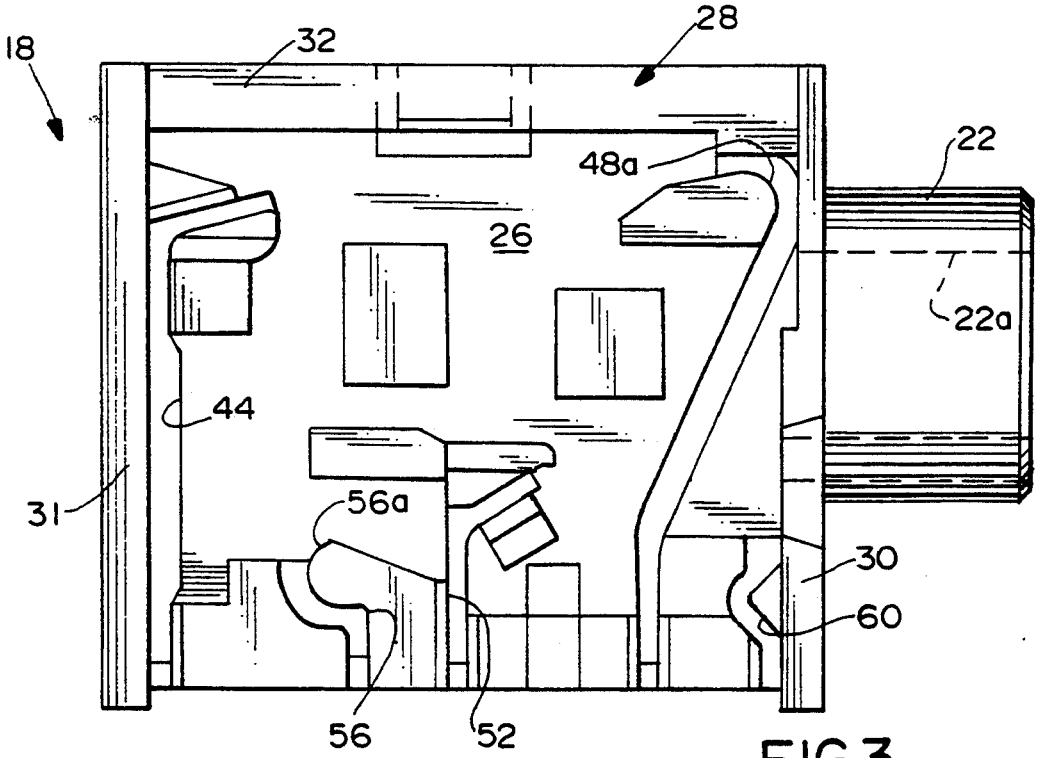
FIG. 3 is an axial section through the dielectric housing of the jack assembly.
Figure 6:
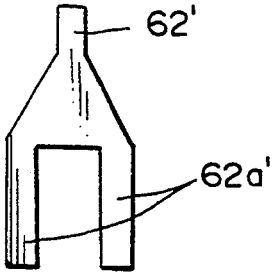
FIG. 6 is a fragmented elevational view of an alternate form of ground terminal.

Referring to FIGS. 3 and 4, dielectric housing 18, particularly main body portion 28, is molded of plastic or like material with various terminal supporting grooves and terminal pivot support means for mounting two pairs of fixed and movable terminals, along with one ground terminal. More particularly, the housing includes a supporting groove 44 and a fixed support means 44*a* for mounting a first fixed signal terminal, generally designated 46; a supporting groove 48 and a pivot support means 48*a* for mounting a first movable signal terminal, generally designated 50; a supporting groove 52 and a fixed support means 52*a* for mounting a second fixed terminal, generally designated 54; a supporting groove 56 and a pivot support means 56*a* for mounting a second movable terminal, generally designated 58; and a supporting groove 60 for mounting a ground terminal, generally designated 62.

More particularly, first fixed terminal 46 includes a tail portion 46*a* at one end and a rounded contact portion 46*b* at its opposite end. The tail portion is insertable into an appropriate hole in printed circuit board 42 for electrical coupling to a circuit trace on the board or in the hole. Rounded contact portion 46*b* is rigidly supported or backed-up by fixed support means 44*a* of the housing.

Similarly, second fixed terminal 54 includes a tail portion 54*a* for coupling to a circuit trace on the printed circuit board, and a rounded contact portion 54*b* rigidly supported or backed-up by fixed support means 52*a* of the housing.

First movable terminal 50 includes a tail portion 50*a* for coupling to an appropriate circuit trace on the printed circuit board, and a pivot portion 50*b* fixedly sandwiched between pivot support means 48*a* of the housing and a curved portion 48*b* of supporting groove 48 in the housing.

Similarly, second movable terminal 58 includes a tail portion 58*a* for coupling to an appropriate circuit trace on the printed circuit board, and a pivot portion 58*b* wrapped about pivot support means 56*a* of the housing.

Ground terminal 62 has a tail portion 62*a* for coupling to a ground trace on the printed circuit board, and a contact portion 62*b* which projects into aperture 22*a* defined by circular boss 22 of the housing for contacting coaxial plug 14, as described hereinafter.

The invention contemplates the novel provision of an improved wiping action between movable signal terminals 50 and 58 and fixed signal terminals 46 and 54, respectively, in response to insertion of coaxial plug 14 into engagement with the movable terminals. More particularly, referring first to movable terminal 50, the terminal includes a contact portion 50*c* at the distal end of a cantilevered spring contact arm, generally designated 50*d*, for engaging rounded contact portion 46*b* of fixed terminal 46. The cantilevered spring contact arm is configured to have a dog-leg configuration to define a pair of legs 50*e* joined at an apex 50*f* to define an angle "D" between the legs. Terminal 50 is mounted within supporting groove 48 and about pivot support means 48*a* in such a manner as to preload cantilevered spring contact arm 50*d* when contact portion 50*c* is in engagement with rounded contact portion 46*b* of fixed terminal 46. In this preloaded condition, angle "D" between legs 50*e* of the dog-leg configuration is "compressed".

Similarly, movable signal terminal 58 includes a cantilevered spring contact arm, generally designated 58*d*, which has a dog-leg configuration to define a pair of legs 58*e* joined at an apex 58*f*. One of the legs of the dog-legged spring contact arm on the distal side of apex 58*f* is maintained in engagement with rounded contact portion 54*b* of fixed terminal 54 in a preloaded condition. Again, like movable terminal 50, an angle "E" between legs 58*e* of movable terminal 58 is "compressed" in the preloaded condition of the terminal. The movable terminal has a rounded plug-engaging portion 58*g* near a distal end thereof.

Figure 5:
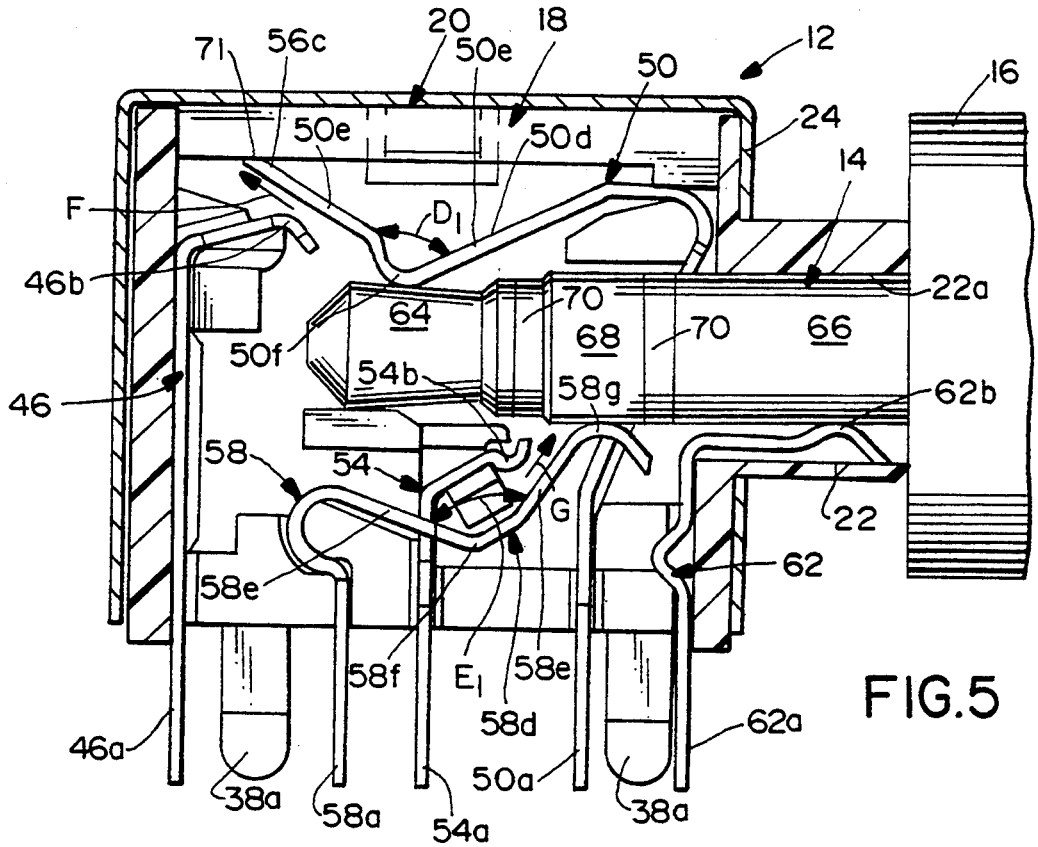
FIG. 5 is a view similar to that of FIG. 4, with the shield of the jack assembly added, and with the coaxial plug inserted into the jack assembly.

FIG. 5 shows coaxial plug 14 inserted into jack assembly 12, with the plug engaging movable terminals 50 and 58 as well as ground terminal 62. Before proceeding, it should be noted that the coaxial plug includes a tip terminal portion 64 at the distal end thereof, a ground terminal portion 66 at the proximal end thereof and an intermediate terminal portion 68 therebetween, the terminal portions being separated and insulated by dielectric insulators 70, all of which is known in the art. It can be seen that tip terminal portion 64 has engaged cantilevered spring contact arm 50*d* of movable terminal 50 at apex 50*f* of the dog-legged configuration of the spring contact arm. Intermediate terminal portion 68 of the coaxial plug has engaged plug-engaging portion 58*g* of movable terminal 58. Proximal terminal portion 66 of the coaxial plug has engaged contact portion 62*b* of ground terminal 62.

As stated above, movable signal terminals 50 and 58, particularly their dog-leg configured spring contact arms 50*d* and 58*d*, respectively, are mounted within the jack assembly in a preloaded condition. This biases contact portion 50*c* of movable terminal 50 against rounded contact portion 46*b* of fixed terminal 46, and biases distal leg 58*e* of movable terminal 58 against contact portion 54*b* of fixed terminal 54. When coaxial plug 14 engages the movable terminals, not only do the contact portions of the movable terminals move off of the contact portions of the fixed terminals, but a significant wiping action is effected because of the dog-leg configuration of the cantilevered spring contact arms of the movable terminals.

More particularly, referring first to movable terminal 50 in FIG. 5, it can be seen that contact portion 50*c* of the movable terminal has moved off of contact portion 46*b* of fixed terminal 46. When this switching or disengagement action occurs, legs 50*e* of the spring contact arm become "relaxed" from their preloaded condition. In other words, angle "D" (FIG. 4) between the legs effectively expands or enlarges to an angle "D1" shown in FIG. 5. Angle "D1" (FIG. 5) is larger than angle "D" (FIG. 4). The resulting, exaggerated action is to cause contact portion 56*c* of movable terminal 50 to ride along and wipe over contact portion 46*b* of fixed terminal 46 in the direction of arrow "F" (FIG. 5) rather than simply lifting off of the fixed contact portion.

Similarly, when the coaxial plug engages portion 58*g* of movable terminal 58 to move the distal leg 58*e* of the terminal off of contact portion 54*b* of fixed terminal 54, angle "E" (FIG. 4) expands or enlarges to an angle "E1" as seen in FIG. 5, as the preloaded dog-leg configuration of the cantilevered spring contact arm of movable terminal 58 becomes relaxed. Again, this creates an exaggerated wiping action across fixed contact portion 54*b* in the direction of arrow "G" (FIG. 5).

It also can be seen in FIG. 5 that the tip of contact portion 50*c* of movable terminal 50 is in abutment with the inside of the housing, as at 71, under the pressure of engagement of the coaxial plug with apex 50*f* of the terminal. This abutment increases the normal contact force between the terminal and the coaxial plug.

FIGS. 6–9 show various forms of the jack assembly for enhancing the grounding capabilities of the assembly. First, referring to FIG. 6, the lower end of a ground terminal 62' (corresponding to ground terminal 62 in FIG. 4) is provided with a pair of tail portions 62*a'* for insertion into a corresponding pair of appropriate holes in printed circuit board 42. These multiple tails of the ground terminal provide multiple grounding paths to reduce the impedance of the system. The multiple tails also provide an improved ground termination to the pc board and thereby are capable of enhancing the shielding effect.

Figure 7:
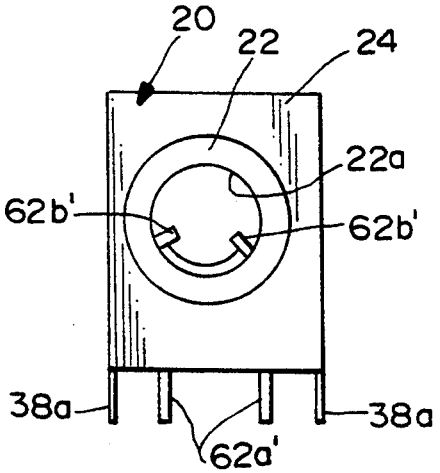
FIG. 7 is a front elevational view of a second embodiment of a jack assembly illustrating a further form of ground terminal.

FIG. 7 shows a further improvement wherein the ground terminal not only has a pair of tail portions 62*a'*, but also a pair of contact portions 62*b'* projecting into aperture 22*a* of cylindrical boss 22 of the dielectric housing for engaging terminal portion 66 of the coaxial plug. The contact portions 62*b'* increase the surface contact area between the ground terminal and the plug ground terminal portion, again reducing the impedance of the system.

Figure 8:
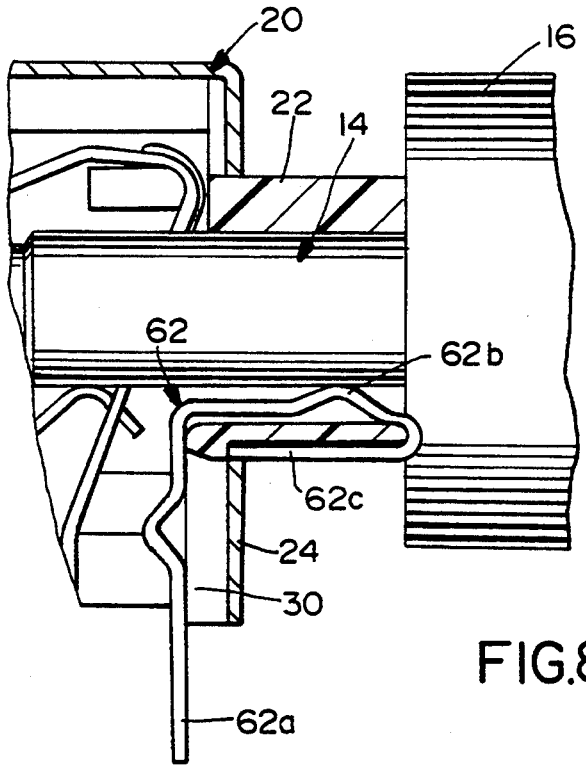
FIG. 8 is a view similar to that of FIG. 7, partially in section, to show another form of grounding system between the shield and the coaxial plug.

FIG. 8 shows an embodiment wherein contact portion 62*b* of ground terminal 62 is extended and wrapped about the outside of cylindrical boss 22 of the housing, with a distal end 62*c* of the ground terminal in engagement with front wall 24 of shield 20. Therefore, the coaxial plug not only has a ground path to the printed circuit board directly through ground terminal 62, but the ground terminal, in turn, is coupled to the ground plane of the printed circuit board through the shield and its grounding legs 38*a* (FIGS. 1 and 2).

Figure 9:
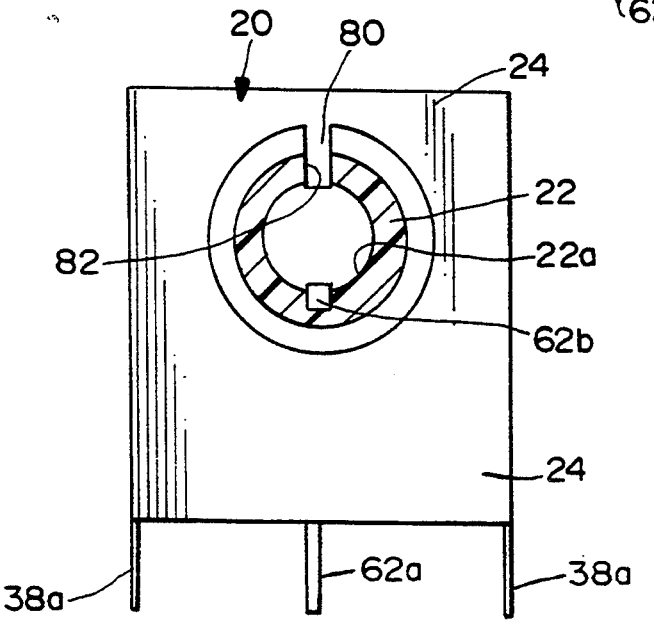
FIG. 9 is a view similar to that of FIG. 8, showing still a further form of grounding system between the shield and the coaxial plug.

FIG. 9 shows an improved grounding scheme wherein the ground terminal portion of the coaxial plug is coupled directly to shield 20 for improving the grounding characteristics of the jack assembly. More particularly, contact portion 62*b* of ground terminal 62 can be seen exposed within aperture 22*a* of cylindrical boss 22 of the dielectric housing. In addition, front wall 24 of shield 20 includes a finger 80 which extends through a hole 82 in cylindrical boss 22 and, like ground contact portion 62*b*, is exposed within aperture 22*a* for engagement by the coaxial plug, particularly terminal portion 66 of the coaxial plug. Therefore, like the embodiment shown in FIG. 8, the coaxial plug is coupled to the ground plane of the printed circuit board both through ground terminal 62 as well as through shield 20 and legs 38*a* of the shield.

Figure 10:
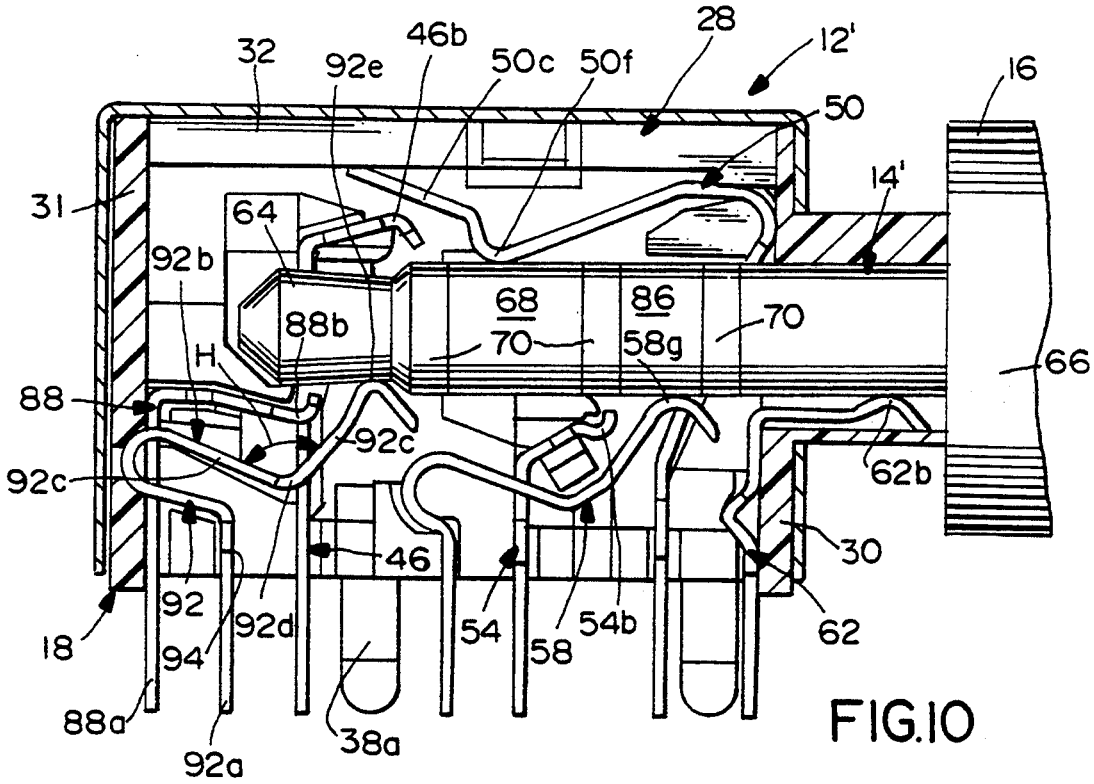
FIG. 10 is a view similar to that of FIG. 5, but of another embodiment of a jack assembly.

Lastly, FIG. 10 shows an alternate embodiment of a jack assembly, generally designated 12', which is similar to jack assembly 12 except that it is adapted for receiving a coaxial plug 14' having three signal terminal portions and a ground terminal portion. It can be seen that the coaxial plug has the tip or distal terminal portion 64 at one end, the proximal or ground terminal portion 66 at the opposite end, with intermediate terminal portion 68 and a second intermediate terminal portion 86 therebetween. Consequently, jack assembly 12' has an additional or third pair of fixed and movable terminals. In order to simplify the description of jack assembly 12', like numerals have been applied to like components, including the first and second pairs of fixed and movable signal terminals and the ground terminal, as described above in relation to the description of jack assembly 12.

More particularly, jack assembly 12' (FIG. 10) includes a third fixed terminal, generally designated 88, mounted within a supporting groove 90 in the housing. Fixed terminal 88 includes a tail portion 88*a* and a fixed contact portion 88*b*.

Jack assembly 12' also includes a third movable terminal, generally designated 92, mounted within a supporting groove 94 in the housing. Movable terminal 92 includes a tail portion 92*a* and a dog leg cantilevered spring contact portion, generally designated 92*b*, defining a pair of legs 92*c* joined at an apex 92*d*. A rounded contact portion 92*e* is formed at the distal end of the movable terminal. Like movable terminals 50 and 58, movable terminal 92 is mounted within the housing in a preloaded condition with one of legs 92*c* (the right-hand leg in FIG. 10) biased against contact portion 88*b* of fixed terminal 88. In this preloaded condition, legs 92*c* define an angle "H" which is "compressed" in the preloaded condition of the terminal.

When coaxial plug 14' is fully inserted into jack assembly 12', tip terminal portion 64 of the coaxial plug engages contact portion 92*e* of terminal 92 and moves the terminal off of the fixed terminal. When this occurs, angle "H" between legs 92*c* enlarges or expands and effects an exaggerated wiping motion along fixed contact portion 88*b*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A jack assembly which includes a contact switching system for receiving a coaxial plug, comprising:

an insulative housing having a terminal-receiving chamber and an aperture communicating with the chamber for insertion therethrough of the coaxial plug, the housing including a terminal pivot support means in the chamber;

a fixed terminal mounted on the housing and including a tail portion for soldering to a circuit board, a fixed rounded contact portion located in the chamber and a connecting portion extending between said tail portion and said fixed rounded contact portion, a substantial length of said connecting portion being securely located within a slot in a sidewall of said housing; and a movable terminal mounted on the housing and including a cantilevered spring contact arm projecting from said terminal pivot support means for pivoting thereabout, the spring contact arm including a first contact portion for contacting the rounded contact portion of the fixed terminal and a second contact portion for contacting the coaxial plug when inserted into the chamber, the spring contact arm being resiliently preloaded to act as the sole means to bias the first contact portion against the rounded contact portion of the fixed terminal, and the spring arm being configured so that the first contact portion slides along and wipes over the rounded contact portion when the coaxial plug is inserted into the chamber and in contact with the second contact portion, wherein said cantilevered spring contact arm has a pair of relatively angled legs defining a dog-leg configuration, an end of one of the legs defining said second contact portion, an end of the other leg being pivotable about said terminal pivot support means, and said first contact portion being located between the end of the first section and a point where the sections converge.

2. The jack assembly of claim 1 wherein said angled legs converge at said second contact portion.

3. The jack assembly of claim 1 wherein said first contact portion is rounded.

4. The jack assembly of claim 1 wherein the coaxial plug includes a shield means, said housing is adapted for mounting on a printed circuit board, and including a ground terminal mounted on the housing in position for engaging the shield means, the ground terminal having at least two integral tail portions projecting from the housing for interconnection to appropriate ground traces on the printed circuit board.

5. The jack assembly of claim 1 wherein the coaxial plug includes a circumferential shield means, and including a ground terminal mounted on the housing with at least two integral contact portions for engaging the shield means at two circumferential locations thereof.

6. The jack assembly of claim 5 wherein said housing is adapted for mounting on a printed circuit board, and the ground terminal includes at least two integral tail portions projecting from the housing for interconnection to appropriate ground traces on the circuit board.

7. A jack assembly which includes a contact switching system for receiving a coaxial plug including a circumferential shield means, comprising:

an insulative housing adapted for mounting on a printed circuit board and having a terminal-receiving chamber and an aperture communicating with the chamber for insertion therethrough of the coaxial plug, the housing including a terminal pivot support means in the chamber;

a fixed terminal mounted on the housing and including a fixed rounded contact portion located in the chamber;

a movable terminal mounted on the housing and including a cantilevered spring contact arm projecting from said terminal pivot support means for pivoting thereabout, the spring contact arm including a first contact portion for contacting the rounded contact portion of the fixed terminal and a second contact portion for contacting the coaxial plug when inserted into the chamber, the spring contact arm being resiliently preloaded to bias the first contact portion against the rounded contact portion of the fixed terminal, and the spring arm being configured so that the first contact portion slides along and wipes over the rounded contact portion when the coaxial plug is inserted into the chamber and in contact with the second contact portion;

a ground terminal mounted on the housing, the ground terminal including an integral contact portion for engaging the shield means of the coaxial plug and an integral tail portion for interconnection to an appropriate ground trace on the circuit board; and a shield about at least a portion of the housing at least in the area of said aperture, the shield including an integral contact portion for engaging the shield means of the coaxial plug and an integral tail portion for interconnection to an appropriate ground trace on the circuit board.

8. The jack assembly of claim 7 wherein the spring contact arm is the sole means to bias the first contact portion against the rounded contact portion of the fixed terminal.

9. A jack assembly which includes a contact switching system for receiving a coaxial plug including a circumferential shield means, comprising:

an insulative housing having a terminal-receiving chamber and a hollow boss projecting from said housing about an aperture communicating with the chamber for insertion therethrough of the coaxial plug, the housing including a terminal pivot support means in the chamber;

a fixed terminal mounted on the housing and including a fixed rounded contact portion located in the chamber;

a movable terminal mounted on the housing and including a cantilevered spring contact arm projecting from said terminal pivot support means for pivoting thereabout, the spring contact arm including a first contact portion for contacting the rounded contact portion of the fixed terminal and a second contact portion for contacting the coaxial plug when inserted into the chamber, the spring contact arm being resiliently preloaded to bias the first contact portion against the rounded contact portion of the fixed terminal, and the spring arm being configured so that the first contact portion slides along and wipes over the rounded contact portion when the coaxial plug is inserted into the chamber and in contact with the second contact portion;

a conductive shield about at least a portion of the housing at least about said boss; and a ground terminal mounted on the housing, the ground terminal including an integral plug contact portion projecting into the inside of the boss for engaging the shield means of the coaxial plug and further including an integral shield contact portion for directly engaging said shield.

10. The jack assembly of claim 9 wherein the spring contact arm is the sole means to bias the first contact portion against the rounded contact portion of the fixed terminal.

11. The jack assembly of claim 9 wherein said housing is adapted for mounting on a printed circuit board, and the ground terminal includes at least two integral tail portions projecting from the housing for interconnection to appropriate ground traces on the circuit board.

12. The jack assembly of claim 11 wherein the spring contact arm is the sole means to bias the first contact portion against the rounded contact portion of the fixed terminal.

13. The jack assembly of claim 9 wherein said housing is adapted for mounting on a printed circuit board, and the ground terminal includes at least one integral tail portion projecting from the housing for interconnection to an appropriate ground traces on the circuit board.

14. The jack assembly of claim 13 wherein the spring contact arm is the sole means to bias the first contact portion against the rounded contact portion of the fixed terminal.

* * * * *